US007810170B1

(12) United States Patent
Guthrie

(10) Patent No.: US 7,810,170 B1
(45) Date of Patent: Oct. 12, 2010

(54) PROTECTIVE OUTERWEAR APPARATUS

(76) Inventor: Mark A. Guthrie, 227 Redbank Trail, Gamalieil, AR (US) 72635

( * ) Notice: Subject to any disclaimer, the term of this patent is extended or adjusted under 35 U.S.C. 154(b) by 713 days.

(21) Appl. No.: 11/828,644

(22) Filed: Jul. 26, 2007

(51) Int. Cl.
*A41B 13/06* (2006.01)

(52) U.S. Cl. ..... 2/69.5; 2/69

(58) Field of Classification Search ..... 2/69, 2/69.5, 82, 83, 84, 93, 94, 79, 66, 104, 275, 2/114; 5/419, 420
See application file for complete search history.

(56) References Cited

U.S. PATENT DOCUMENTS

| | | | | | |
|---|---|---|---|---|---|
| 2,372,110 | A * | 3/1945 | Noone | 2/84 |
| 2,911,649 | A * | 11/1959 | Ruelle et al. | 2/69.5 |
| 4,103,377 | A * | 8/1978 | Mayer et al. | 2/69.5 |
| 4,138,742 | A * | 2/1979 | Meeks | 2/84 |
| 4,507,805 | A * | 4/1985 | Calutoiu | 2/69.5 |
| 4,575,876 | A * | 3/1986 | Weaver | 2/69.5 |
| 4,683,593 | A * | 8/1987 | Langley | 2/82 |
| 4,991,245 | A * | 2/1991 | Franco | 5/419 |
| 4,998,296 | A * | 3/1991 | Stames | 2/458 |
| 5,199,120 | A * | 4/1993 | Holmes | 5/419 |
| 5,457,829 | A * | 10/1995 | Elliott | 5/420 |
| 5,560,043 | A * | 10/1996 | Armstrong | 2/69.5 |
| 5,718,000 | A * | 2/1998 | Ost et al. | 2/69 |
| 5,785,219 | A * | 7/1998 | Kraft | 224/576 |
| 5,815,833 | A * | 10/1998 | Kuo | 2/69.5 |
| 5,884,331 | A * | 3/1999 | Barajas | 2/69 |
| 6,061,831 | A * | 5/2000 | Rudolph et al. | 2/69.5 |
| 6,488,188 | B2 * | 12/2002 | Fleischli | 224/153 |
| 7,036,153 | B2 * | 5/2006 | Gibson et al. | 2/69 |
| 7,058,997 | B1 * | 6/2006 | Klinger | 5/413 R |
| 7,581,259 | B2 * | 9/2009 | Thompson | 2/69.5 |
| 2003/0061659 | A1 * | 4/2003 | Dunlap et al. | 5/485 |
| 2007/0050882 | A1 * | 3/2007 | Eisenhuth | 2/69 |
| 2010/0132089 | A1 * | 6/2010 | Myers | 2/79 |

* cited by examiner

*Primary Examiner*—Katherine Moran
*Assistant Examiner*—Richale L Quinn
(74) *Attorney, Agent, or Firm*—Crossley Patent Law; Mark A. Crossley

(57) ABSTRACT

The protective outerwear apparatus is a collapsible suit with a dual function bottom compartment. The compartment provides for insertion of accessory heat, for surface grip, and for a carrying case when the suit is collapsed. The suit is bonded to the inside of the compartment and extends therefrom. Other than the compartment cover, the apparatus comprises only one piece. Optional elastic cuffs are provided for sealing out inclement conditions. The full zipper suit forms a loose fitting body bag, with hood. Chemical heating pads and other warmers are provided for placement in the compartment bottom pouch. The outer bottom of the compartment is provided with a plurality of grips for aiding traction. The suit is provided in a variety of materials, which include neoprene and other rubberized materials. The apparatus thereby provides a rapidly deployed weatherproof suit which is easily stored and conveyed after use.

1 Claim, 3 Drawing Sheets

PROTECTIVE OUTERWEAR APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

When in the outdoors for extended periods of time, it is often necessary to shield oneself from the elements of moisture, wind, and cold. This is especially true for sportsmen who are often required to remain relatively motionless for extended periods of time. Hunting for various game animals and birds are examples of such sporting endeavors wherein those involved are particularly susceptible to the elements. Various clothing items provide protection, but typically only for certain areas of the body. Various other devices have been proposed for shielding users from the elements; however, none provide the basic design and function of the present apparatus, nor the transportability in combination thereof. The present apparatus provides a collapsible suit with a dual function bottom compartment. Provision is made for collapsed carrying, for insertion of accessory heat, and for surface grip for the bottom, where the user's feet are housed.

FIELD OF THE INVENTION

The protective outerwear apparatus relates generally to outdoor apparel and more especially to a selectively worn or carried outerwear apparatus with a semi-flexible bottom compartment.

DESCRIPTION OF THE PRIOR ART

Prior related art is replete with various protective clothing devices. Each provides solution to a specific problem. None provide the basic functional solutions of the present apparatus' uses. U.S. Pat. No. 4,575,876 issued to Weaver 1986-03-18 teaches a jacket with sleeping bag. The device does not teach seated or standing use, as does the present apparatus. The device must inherently be relatively light weight, as the sleeping bag replaces the jacket lining. The device cannot therefore include a semi-rigid, pliable bottom compartment, as does the present apparatus. U.S. Pat. No. 5,815,833 issued to Kuo 1998-10-06 teaches a convertible article for simultaneously providing sleeping bag, jacket, and carrying bag. The device is overly complex compared to the present apparatus. The device cannot provide the foot protection and accessory heat and grip of the present apparatus. U.S. Pat. No. 6,061,831 issued to Rudolph et al. 2000-05-16 teaches a coat-sleeping bag/backpack combination, termed "coatbag".

The Rudolph device is far more complex than the present apparatus, thereby necessitating a relatively increased cost of production and sale. The device cannot provide the foot compartment of the present apparatus.

While the above-described devices fulfill their respective and particular objects and requirements, they do not describe a protective outerwear apparatus that provides for the advantages of the protective outerwear apparatus. In this respect, the protective outerwear apparatus substantially departs from the conventional concepts and designs of the prior art. Therefore, a need exists for an improved protective outerwear apparatus.

SUMMARY OF THE INVENTION

The general purpose of the protective outerwear apparatus, described subsequently in greater detail, is to provide a protective outerwear apparatus which has many novel features that result in an improved protective outerwear apparatus which is not anticipated, rendered obvious, suggested, or even implied by prior art, either alone or in combination thereof.

To attain this, the protective outerwear apparatus comprises a collapsible suit with a dual function bottom compartment. Provision is made for collapsed carrying, for insertion of accessory heat, and for surface grip for the bottom, where the user's feet are housed. The bottom compartment provides a carrying case when the suit is collapsed. The compartment provides five sides, and a removable flexible cover provides compartment closure.

The bottom is semi-rigid, or pliable, meaning that the rubber bottom will flex somewhat, but holds its shape in use. The pliable bottom also provides excellent durability for use as a carrying case. Outdoor equipment is typically subjected to rough transport and often comes in contact with other equipment which can harm lightweight materials which are less durable than the present apparatus. The pliable bottom and the durable flexible cover prevent damage associated with storage and transport. The cover is provided in various materials which include rubber, synthetics, and treated canvas. The suit is bonded to the inside of the compartment and extends therefrom. Other than the cover, the apparatus is comprised of only one piece. A user need only remove the cover to enable pulling the suit out, then slipping it on. Optional elastic cuffs are provided for sealing out inclement conditions. The full zipper suit forms a loose fitting body bag, with hood. Chemical heating pads and other warmers are provided for placement in the compartment bottom as needed. The outer bottom of the compartment is provided with a plurality of grips for aiding traction. The suit is provided in a variety of materials, which include neoprene, rubberized material, and other suitable materials. The apparatus thereby provides an easily and rapidly utilized weatherproof suit which is easily stored and conveyed after use. The pliable bottom and durable suit provide for extended wear, and repetitive long-lived use.

The apparatus is provided in a plurality of colors, including but not limited to camouflage, white, hunter orange. The apparatus is provided in a plurality of sizes for both youth and adults.

Thus has been broadly outlined the more important features of the improved protective outerwear apparatus so that the detailed description thereof that follows may be better understood and in order that the present contribution to the art may be better appreciated.

An object of the protective outerwear apparatus is to be basic.

Another object of the protective outerwear apparatus is to be inexpensively produced and sold.

A further object of the protective outerwear apparatus is to provide for collapse into a pliable, protective compartment.

An added object of the protective outerwear apparatus is to provide one-zipper closure.

And, an object of the protective outerwear apparatus is to be durable for extended, repetitive use.

These together with additional objects, features and advantages of the improved protective outerwear apparatus will be readily apparent to those of ordinary skill in the art upon reading the following detailed description of presently preferred, but nonetheless illustrative, embodiments of the improved protective outerwear apparatus when taken in conjunction with the accompanying drawings.

In this respect, before explaining the current embodiments of the improved protective outerwear apparatus in detail, it is to be understood that the protective outerwear apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved protective outerwear apparatus. It is therefore important that the claims be regarded as including such equivalent constructions insofar as they do not depart from the spirit and scope of the protective outerwear apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the protective outerwear apparatus generally designated by the reference number 10 will be described.

Figure 3:
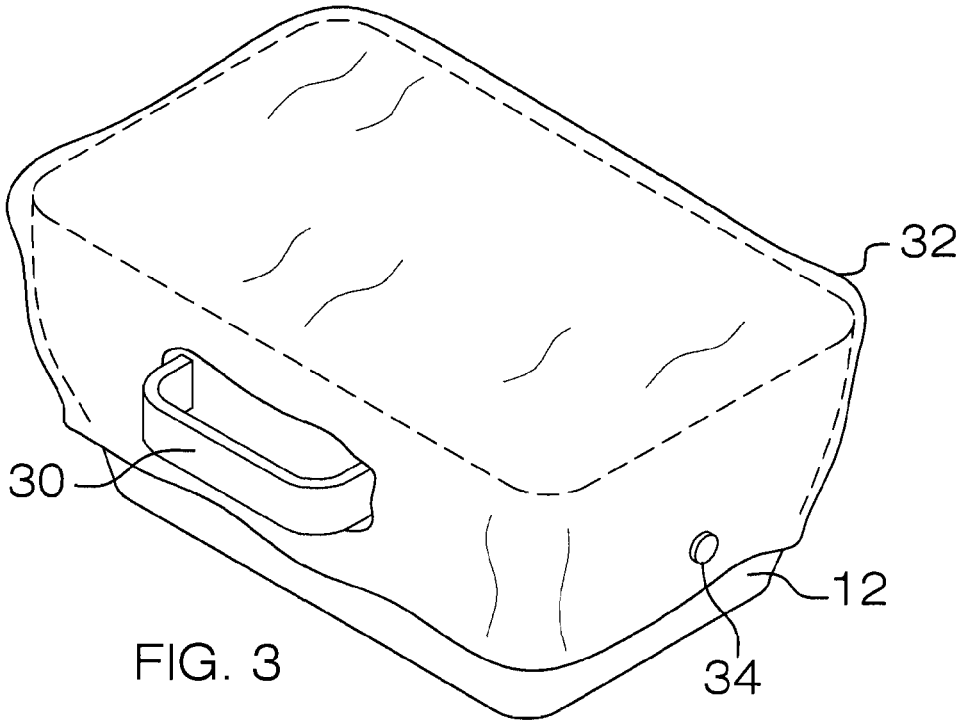
FIG. 3 is top perspective view of the apparatus ready for transport.
Figure 4:
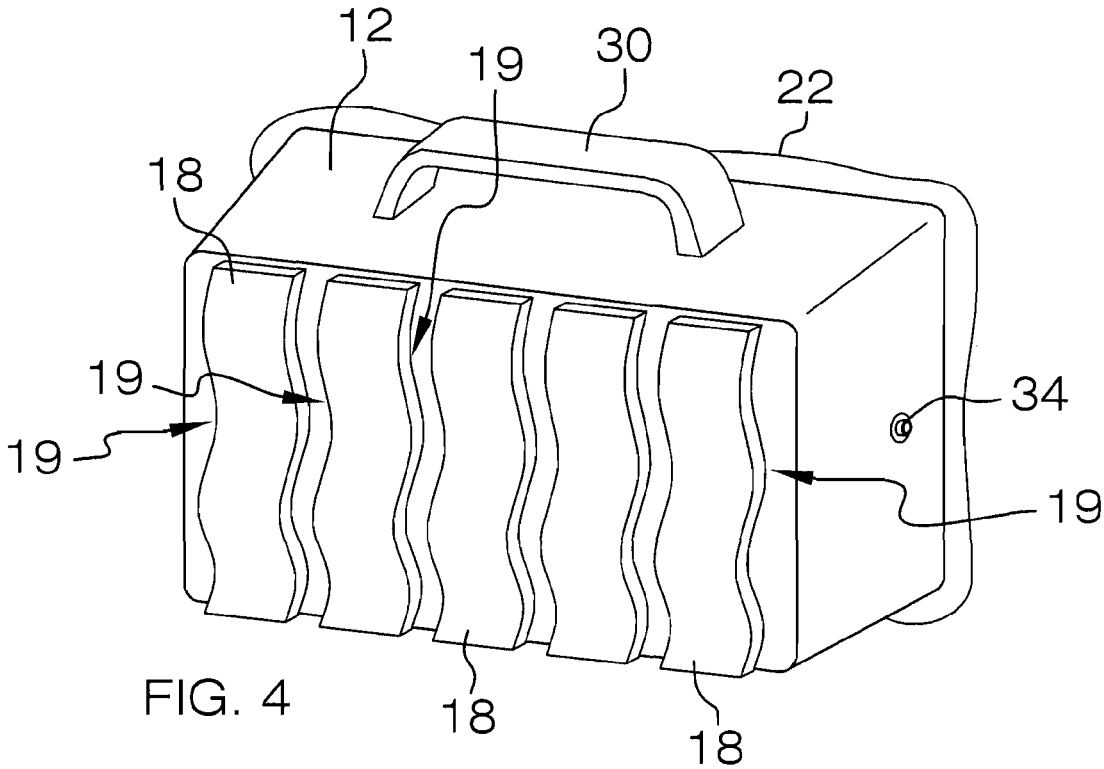
FIG. 4 is bottom perspective view of the apparatus in a collapsed state, with cover removed.

Referring to FIGS. 3 and 4, the protective outerwear apparatus 10 partially comprises the bottom compartment 12 which is pliable carrying case/foot compartment 12. The parallelepiped compartment 12 has four sides and a bottom. The compartment further comprises an open top, an inside, and an outside. The plurality of grips 18 is disposed on the outside of the bottom. Each grip 18 has spaced apart sides and ends. The sides of each grip 18 further comprise a plurality of waves 19 in each side of the grips 18. The flexible cover 32 is provided for selectively covering the open top of the compartment 12. At least two snaps 34 are provided on the exterior of the compartment 12. At least two snaps 34 are provided on the cover 32 for removably fastening the cover 43 to the compartment 23. The snaps 34 provide for long lasting, durable fastening. The handle 30 is provided on the outside of the compartment 12 to aid in transport of the apparatus 10.

Figure 1:
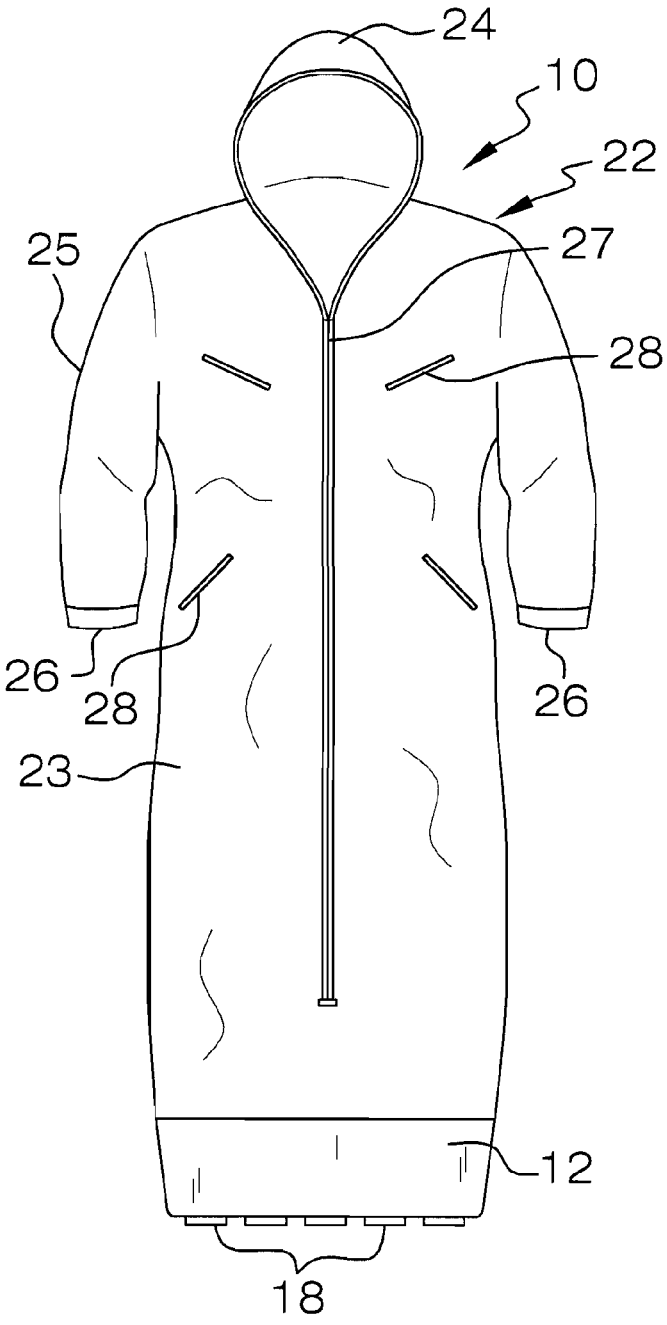
FIG. 1 is a front elevation view.
Figure 2:
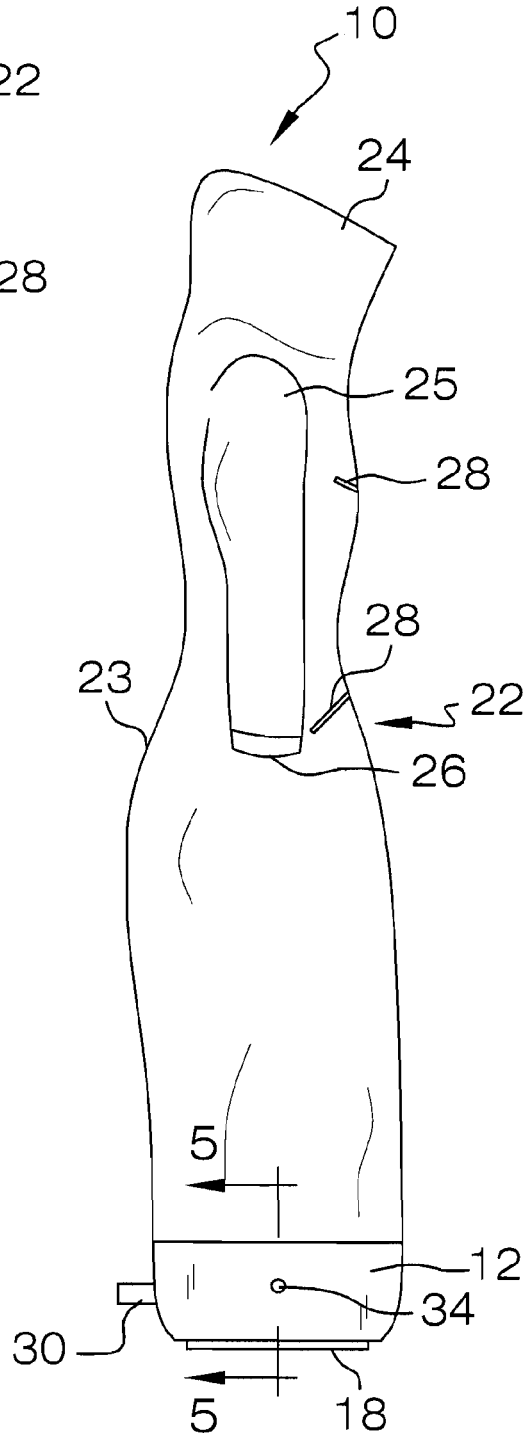
FIG. 2 is a side elevation view.
Figure 5:
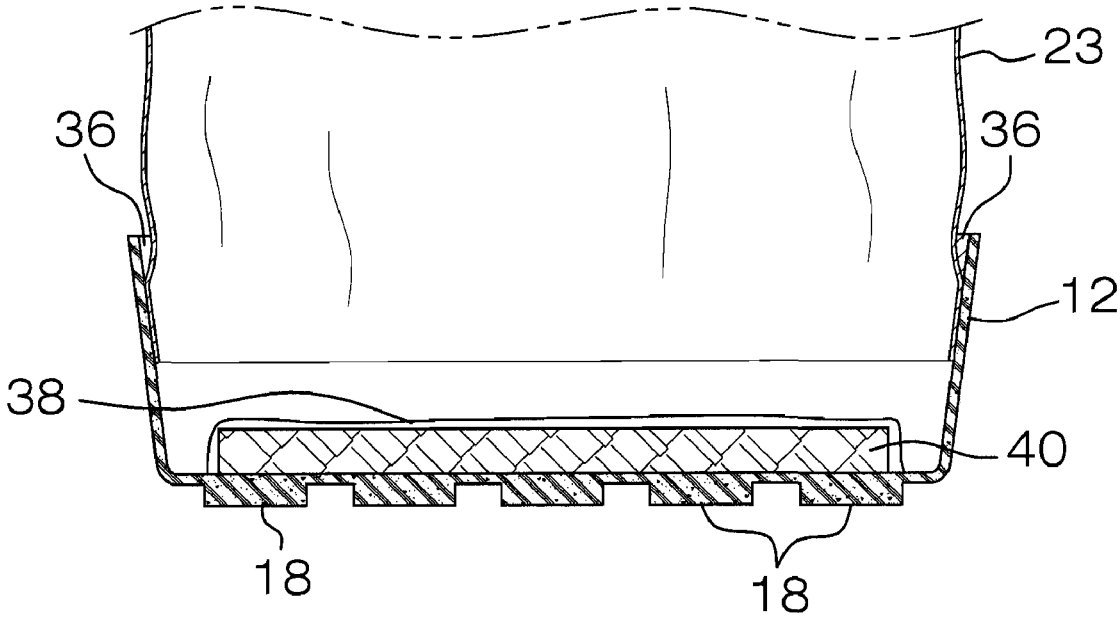
FIG. 5 is a partial cross sectional view of FIG. 2.

Referring to FIGS. 1, 2, and 5, the pouch 38 is disposed in the bottom of the inside of the compartment 12. The removable heat source 40 is provided for insertion into the pouch 38 of the compartment 12. The heat source 40 provided in the illustrated embodiment is comprised of chemical heat generation. Such heat sources 40 are known in the arts. Other heat sources 40 are also provided. The suit 22 comprises an open bottom end. The bottom end of the suit 22 is joined to the inside of the compartment 12 sides. The flexible seal 36 is disposed at the joining of the bottom of the suit 22 to the inside of the compartment 12 sides. The seal 36 acts to prevent any moisture pooling and further acts to insure against leaks in the suit 22-compartment 12 joining. The body 23 of the suit 22 is seamlessly joined to the bottom end of the suit 22.

The pair of opposed sleeves 25 is joined to the body 23. An elastic cuff 26 is disposed at the end of each sleeve 25 to best ward off inclement conditions from the user. The hood 24 is joined to the body 23. The zipper 27 is provided for continuous closure of the body 23 and the hood 24. The plurality of pockets 28 is provided in the body 23.

With respect to the above description then, it is to be realized that the optimum dimensional relationships for the parts of the protective outerwear apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the protective outerwear apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the protective outerwear apparatus may be used.

Therefore, the foregoing is considered as illustrative only of the principles of the protective outerwear apparatus. Further, since numerous modifications and changes will readily occur to those skilled in the art, it is not desired to limit the protective outerwear apparatus to the exact construction and operation shown and described, and accordingly, all suitable modifications and equivalents may be resorted to, falling within the scope of the protective outerwear apparatus.

What is claimed is:

1. A protective outerwear apparatus with combined pliable carrying case/foot compartment, the apparatus comprising:

the compartment having four sides and a bottom, an open top, an inside, and an outside;

a plurality of grips on the outside of the bottom, each grip having spaced apart sides and ends;

a plurality of waves in each side of the grips;

a pouch in a bottom of the inside of the compartment;

a removable heat source for insertion into the pouch;

at least two snaps on the outside of the compartment;

a suit comprising:

a open bottom end, the bottom end joined to the inside of the compartment sides;

a body seamlessly joined to the bottom end;

a pair of opposed sleeves joined to the body;

an elastic cuff at an end of each sleeve;

a hood joined to the body;

a zipper closure for the body and hood;

a plurality of pockets in the body;

a flexible seal disposed at the joining of the bottom end of the suit to the inside of the compartment sides;

a flexible cover for selectively covering the open top of the compartment;

a least two snaps for removably fastening the cover to the compartment;

a handle on the outside of the compartment.

* * * * *